US012338034B2

(12) United States Patent
Wang

(10) Patent No.: US 12,338,034 B2
(45) Date of Patent: Jun. 24, 2025

(54) PACKAGED PRODUCT AND METHOD OF MANUFACTURING AND USING THE SAME

(71) Applicant: Colgate-Palmolive Company, New York, NY (US)

(72) Inventor: Jun Wang, Fort Washington, PA (US)

(73) Assignee: Colgate-Palmolive Company, New York, NY (US)

( * ) Notice: Subject to any disclaimer, the term of this patent is extended or adjusted under 35 U.S.C. 154(b) by 125 days.

(21) Appl. No.: 18/044,675

(22) PCT Filed: Aug. 25, 2021

(86) PCT No.: PCT/US2021/047518
§ 371 (c)(1),
(2) Date: Mar. 9, 2023

(87) PCT Pub. No.: WO2022/055706
PCT Pub. Date: Mar. 17, 2022

(65) Prior Publication Data

US 2024/0010393 A1 Jan. 11, 2024

Related U.S. Application Data

(60) Provisional application No. 63/076,612, filed on Sep. 10, 2020.

(51) Int. Cl.

| | |
|---|---|
| ***B65D 35/14*** | (2006.01) |
| ***B65D 35/44*** | (2006.01) |
| ***B65D 65/46*** | (2006.01) |

(52) U.S. Cl.
CPC ..... *B65D 35/14* (2013.01); *B65D 35/44* (2013.01); *B65D 65/46* (2013.01); *B65D 2565/385* (2013.01)

(58) Field of Classification Search
CPC .. B65D 2565/385; B65D 65/46; B65D 35/12; B65D 35/22; B65D 35/44; B65D 35/14
See application file for complete search history.

(56) References Cited

U.S. PATENT DOCUMENTS

| | | | |
|---|---|---|---|
| 2,297,690 | A | 10/1942 | Nitardy |
| 7,074,390 | B2 | 7/2006 | MacKinnon |

(Continued)

FOREIGN PATENT DOCUMENTS

| | | |
|---|---|---|
| DE | 20318160 | 2/2004 |
| EP | 0266796 | 5/1988 |

(Continued)

OTHER PUBLICATIONS

Goldsberry, Clare, "Colgate's Fully Recyclable Toothpast Tube First to Receive APR Recognition," PlasticsToday.com, Jun. 18, 2019, https://www.plasticstoday.com/packaging/colgate-s-fully-recyclable-toothpaste-tube-first-receive-apr-recognition/115992632861006, retrieved Sep. 10, 2020, pp. 1-7.

(Continued)

*Primary Examiner* — Anthony D Stashick
*Assistant Examiner* — Lauren Kmet

(57) ABSTRACT

A packaged product, a method of manufacturing a package, and a method of dispensing a consumable substance from a package. The packaged product may include a flexible tube having a cavity and an opening that forms a passageway into the cavity. A cap may be detachably coupled to the flexible tube to close the opening. A flexible container may be positioned within the cavity of the flexible tube, and a consumable substance may be disposed within the flexible container, which can be completely sealed and free of openings prior to first use. Introduction of one or more drops of water into the first cavity through the opening in the outer container may dissolve at least a portion of the flexible container thereby forming a hole in the flexible container (Continued)

through which the consumable substance is configured to be dispensed.

15 Claims, 8 Drawing Sheets

(56) References Cited

U.S. PATENT DOCUMENTS

| | | | | |
|---|---|---|---|---|
| 7,287,643 | B1 | 10/2007 | Glover, Sr. | |
| 8,113,729 | B2 | 2/2012 | Solan | |
| 8,728,446 | B2 | 5/2014 | Hurwitz | |
| 8,827,583 | B2 | 9/2014 | Solan | |
| 9,617,042 | B2 | 4/2017 | Dambricourt | |
| 9,750,669 | B2 | 9/2017 | Solan | |
| 2017/0259976 | A1* | 9/2017 | Lee | B65D 65/46 |
| 2018/0319547 | A1* | 11/2018 | Ishii | B65D 35/28 |

FOREIGN PATENT DOCUMENTS

| | | |
|---|---|---|
| WO | 2002/026078 | 4/2002 |
| WO | 2005/055967 | 6/2005 |
| WO | 2016/054528 | 4/2016 |
| WO | 2019/172932 | 9/2019 |
| WO | 2022/055706 | 3/2022 |

OTHER PUBLICATIONS

International Search Report and the Written Opinion of the International Searching Authority issued in International Application PCT/US2021/047518 mailed Dec. 13, 2021.

* cited by examiner

PACKAGED PRODUCT AND METHOD OF MANUFACTURING AND USING THE SAME

CROSS-REFERENCE TO RELATED APPLICATIONS

The present application claims the benefit of priority to U.S. Provisional Patent Application Ser. No. 63/076,612, filed Sep. 10, 2020, the entirety of which is incorporated herein by reference.

BACKGROUND

Recycling is a way to prevent waste material from being deposited in a landfill. Currently, rigid packaging, such as polyethylene terephthalate bottles and high-density polyethylene bottles, may be recycled. However, flexible packaging, such as toothpaste tubes, are often not able to be recycled because they require a laminate structure to provide both moisture and flavor barriers, and this laminate structure typically includes multiple materials that are unable to be separated and cannot be recycled together. Thus, a need exists for a flexible package which can be recycled while also providing the desired moisture and flavor barrier to the product held by the package.

BRIEF SUMMARY

The present invention is directed to a packaged product, a method of manufacturing a package, and a method of dispensing a consumable substance from a package. The packaged product may include a flexible tube having a cavity and an opening that forms a passageway into the cavity. A cap may be detachably coupled to the flexible tube to close the opening. A flexible container may positioned within the cavity of the flexible tube, and a consumable substance may be disposed within the flexible container, which can be completely sealed and free of openings prior to first use. Introduction of one or more drops of water into the first cavity through the opening in the outer container may dissolve at least a portion of the flexible container thereby forming a hole in the flexible container through which the consumable substance is configured to be dispensed.

In one aspect, the invention may be a package for holding and dispensing a consumable substance, the package comprising: an outer container formed from a non-dissolvable material, the outer container having an inner surface that defines a first cavity and an opening that forms a passageway into the first cavity; a cap coupled to the outer container to close the opening; an inner container formed from a dissolvable material positioned within the first cavity of the outer container, the inner container comprising a second cavity and being sealed and free of any openings into the second cavity; and a consumable substance disposed within the second cavity of the inner container; wherein the inner container, when filled with the consumable substance, comprises at least one dimension that prevents removal of the inner container from the first cavity of the outer container while the inner container is sealed.

In another aspect, the invention may be a method of manufacturing a package containing a consumable substance, the method comprising: filling an inner container formed from a dissolvable material with a consumable substance and sealing the inner container; inserting the inner container into a cavity of an outer container through a fill opening in a first end of the outer container, the outer container having a dispensing opening in a second end thereof; and sealing the first end of the outer container to close the fill opening.

In yet another aspect, the invention may be a method of dispensing a consumable substance from a previously unopened package, the method comprising: altering a cap from a closed state to an open state to expose an opening in an end of an outer container formed from a flexible and non-dissolvable material; introducing one or more drops of water into a cavity of the outer container through the opening, the one or more drops of water contacting an inner container that is disposed within the outer container, the inner container containing a consumable substance and being sealed, the one or more drops of water dissolving at least a portion of the inner container to form a hole in the inner container; and squeezing the outer container, thereby forcing a portion of the consumable substance to flow through the hole in the inner container and through the opening in the end of the outer container to dispense the consumable substance from the package.

In a further aspect, the invention may be a packaged product comprising: a flexible tube comprising a cavity and an opening that forms a passageway into the cavity; a cap alterable between a closed state whereby the cap is coupled to the flexible tube and closes the opening and an open state whereby the opening is exposed; a flexible container positioned within the cavity of the flexible tube; and a consumable substance disposed within the flexible container; wherein the flexible container is sealed prior to first use of the packaged product, and wherein introducing one or more drops of water into the first cavity through the opening in the outer container dissolves at least a portion of the flexible container thereby forming a hole in the flexible container through which the consumable substance is configured to be dispensed.

In a still further aspect, the invention may be a packaged product comprising: an outer container comprising a cavity and an opening that forms a passageway into the cavity; a cap coupled to the outer container to close the opening; an inner container positioned within the cavity of the outer container, the inner container being sealed; a consumable substance disposed within the inner container; and wherein the inner container filled with the consumable substance comprises at least one dimension that prevents removal of the inner container from the cavity of the outer container while the inner container is sealed.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
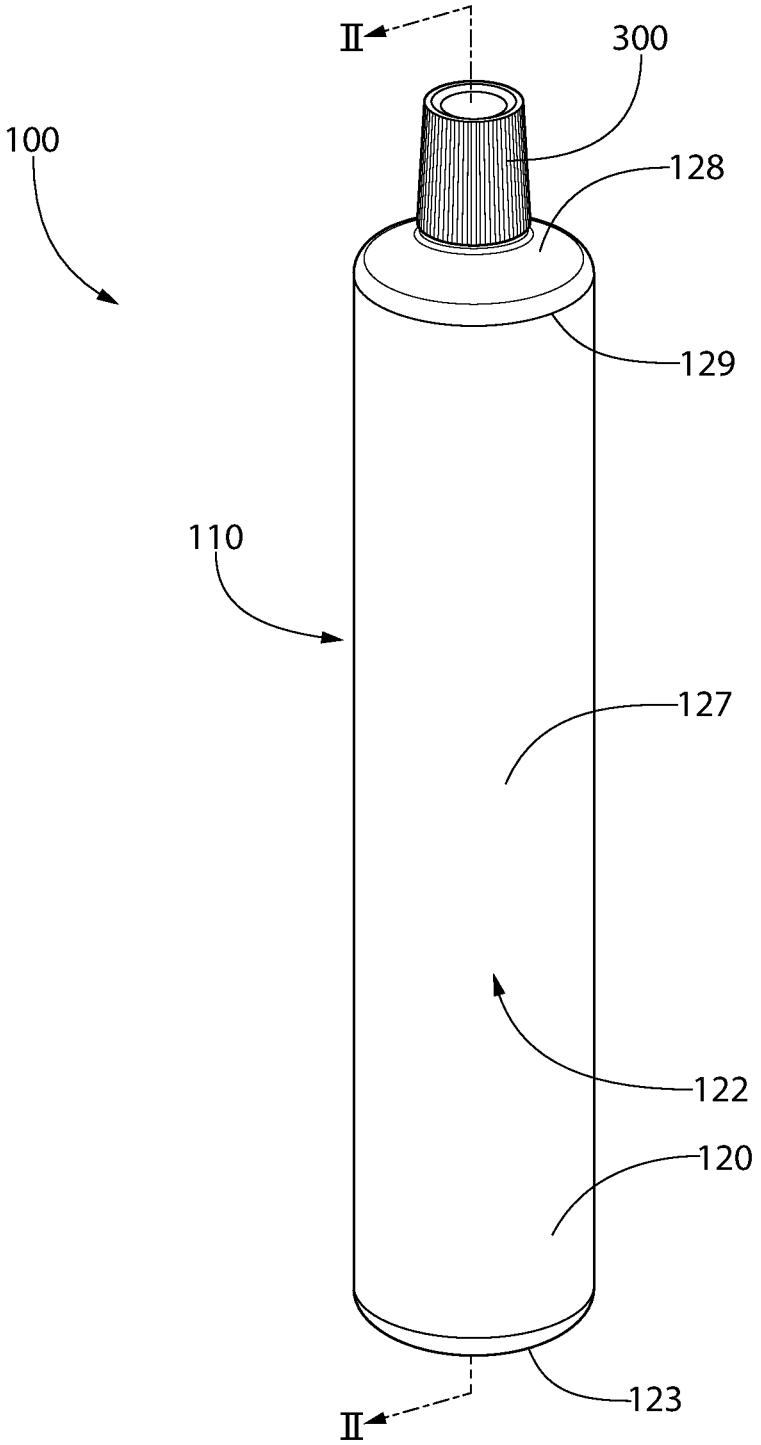
FIG. 1 is a perspective view of a packaged product in accordance with an embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

The present invention is directed to a flexible package that holds and dispenses a consumable substance and which is capable of being recycled. For example, conventional toothpaste tubes are not able to be recycled because they include a flavor or aroma barrier that is formed from aluminum and/or ethylene vinyl alcohol (EVOH). That is, such tubes are laminate structures that include several layers of polyethylene or other recyclable plastics as well as layers of aluminum and/or EVOH. The various layers cannot be separated in a cost-effective manner to enable them to be recycled. Furthermore, there is no process in existence that can recycle plastic together with metal such as aluminum. Thus, there exists a need for a package, such as a toothpaste tube, which can be completely recycled in order to enhance sustainability efforts currently being undertaken by most of the world's largest companies. Of course, the package described herein is not intended to be limited to toothpaste tubes in all embodiments. Rather, the package may be used for holding any of various different consumable substances, some examples of which are set forth herein below. The type of package which is the subject of the present invention described herein is generally flexible or compressible such that it can be squeezed to dispense its contents.

Figure 2:
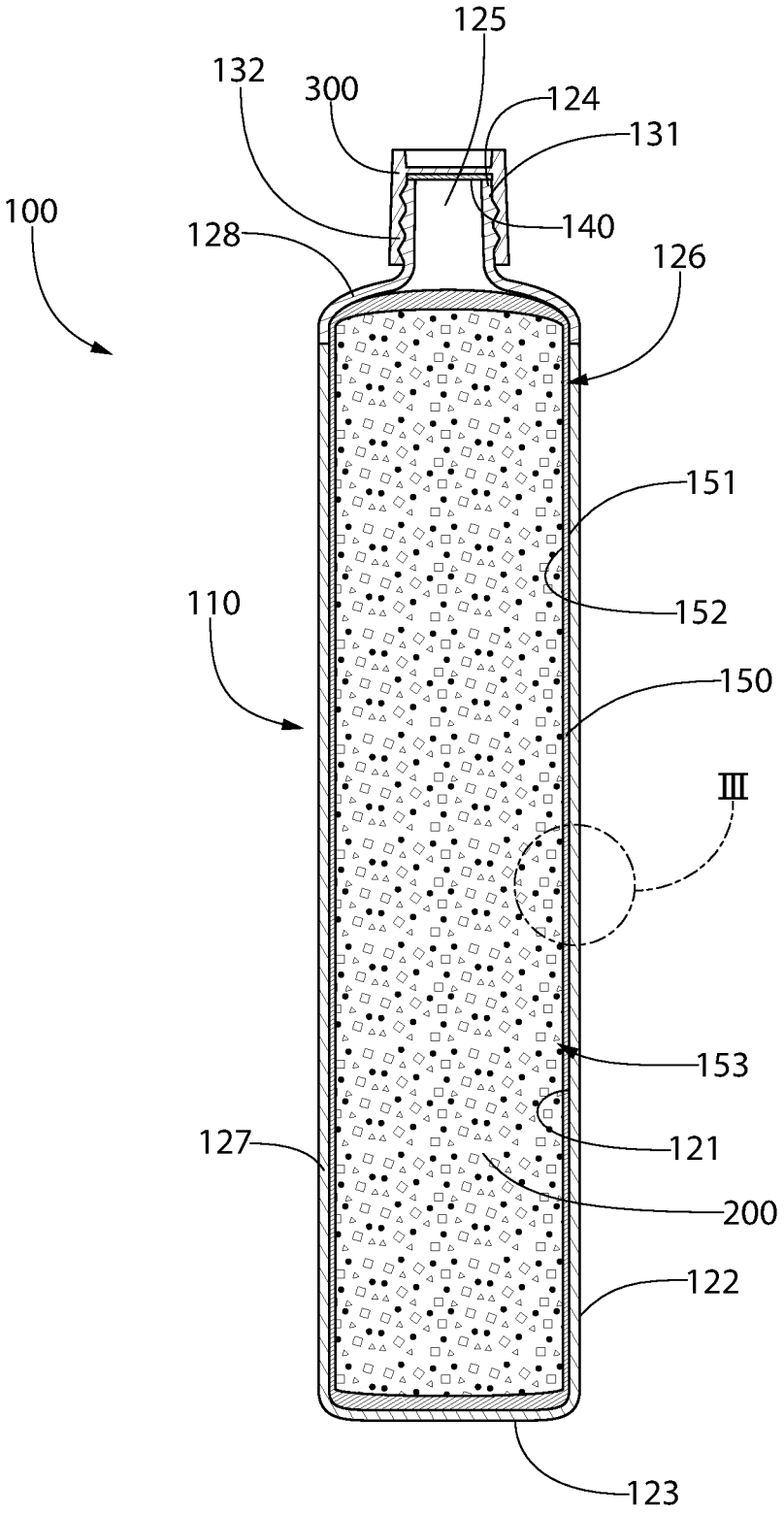
FIG. 2 is a cross-sectional view taken along line II-II of FIG. 1 illustrating an outer container, an inner container, and a consumable substance of the packaged product.

Referring first to FIGS. 1 and 2, a packaged product 100 is illustrated in accordance with an embodiment of the present invention. The packaged product 100 includes a package 110 and a consumable substance 200 that is held by the package 110 prior to dispensing. The package 110 may be flexible and/or compressible in some embodiments so that the consumable substance 200 is dispensed by squeezing the package 110 to force the consumable substance 200 to be dispensed out of the package 110. The consumable substance 200 may also be dispensed by rolling the package 110 from an end opposite its dispensing opening to force the consumable substance 200 to flow out of the dispensing opening. As with a conventional toothpaste tube, squeezing the package 110 may result in deformation of the package 110 as the consumable substance 200 is dispensed. That is, the package 110 does not maintain its shape during its life cycle because air does not enter into the package 110 to replace amounts of the consumable substance 200 that are dispensed. Rather, the package 110 deforms and changes shape or flattens out as more of the consumable substance 200 is dispensed. Of course, in other embodiments the package 110 may be squeezable but may return to its original shape upon cessation of squeezing.

The package 110 comprises an outer container 120 and an inner container 150. The outer container 120 may be referred to in some embodiments as a flexible tube and the inner container 150 may be referred to in some embodiments as a flexible container or a bag. As discussed in greater detail below, the inner container 150 is positioned within the outer container 120 such that the outer container 120 entirely surrounds the inner container 150. Thus, a consumer viewing the package 110 will see only the outer container 120 because the inner container 150 is hidden from view within the interior of the outer container 120. In that regard, the outer container 120 comprises an inner surface 121 and an outer surface 122, with the outer surface 122 of the outer container 120 forming an outer surface of the package 110. The outer surface 122 of the outer container 120 may contain markings or indicia such as product identification information, product use information, company or manufacturer markings or logos, and the like.

The outer container 120, which forms the overall shape of the package 110, may have the size and shape of a traditional toothpaste tube (or other type of tube designed for a different purpose, such as an ointment tube) in some embodiments. In this way, the packaged product 100 will be familiar to the user or consumer because it will have the same overall appearance and function as what the user/consumer is used to. However, the packaged product 100 has unseen benefits due to its material and manufacture which enables it to be recycled while still providing the desired moisture and flavor barriers to increase shelf life and ensure that the consumer is bringing home a high quality product after purchase.

The inner surface 121 of the outer container 120 defines a first cavity 126 of the outer container 120. That is, the outer container 120 is a hollow tubular structure which defines an empty interior cavity. The outer container 120 comprises a first end 123 and a second end 124. In the finished product, the first end 123 of the outer container 120 is closed or sealed (e.g., crimped). There is an opening (i.e., a dispensing opening) 125 in the second end 124 of the outer container 120 through which the contents held within the package 110 may be dispensed, as discussed in greater detail below. In the assembled package 110, the opening 125 in the second end 124 of the outer container 120 is the only opening through which the contents held within the package 110 may be dispensed and the outer container 120 is devoid of any additional openings. The opening 125 provides a passageway from the exterior environment into the cavity 126, and vice versa.

The outer container 120 comprises a sleeve portion 127 and a shoulder portion 128. The sleeve portion 127 extends from the first end 123 to a junction 129 and the shoulder portion 128 extends from the junction 129 to the second end 124. The sleeve portion 127 may have a tubular shape. The shoulder portion 128 may comprise a shoulder 130 and a nozzle 131 extending from the shoulder 130 to the second end 124. In the exemplified embodiment, the nozzle 131 comprises external screw threads 132 on its outer surface that are configured to engage mating screw threads on an interior of a cap 300. That is, the cap 300 is configured to be coupled to the nozzle 131 of the shoulder portion 128 of the outer container 120 to close the opening 125 in the second end 124 of the outer container 120. In some embodiments, the cap 300 may be detachably coupled to the outer container 120 so that when the cap 300 is attached to the outer container 120 the cap 300 closes the opening 125 and when the cap 300 is detached from the outer container 120 the opening 125 is exposed. However, the invention is not to be so limited in all embodiments and in other embodiments the cap 300 may be hingedly coupled to the outer container 120 so that the cap 300 is coupled to the outer container 120 regardless of whether it is closing the opening 125 or not. In either situation, the cap 300 may be alterable between an open state whereby the opening 125 is exposed and a closed state whereby the cap 300 closes the opening 125, regardless of the particular manner in which this is achieved.

In the exemplified embodiment, the outer container 120 is formed from a non-dissolvable material. The outer container 120 is preferably formed from a single type of plastic material so that the outer container 120 is not dissolvable. The term non-dissolvable or not dissolvable refers to a material which does not dissolve when placed into contact with or immersed in water. Thus, placing the outer container 120 inside of a container of water or pouring water onto the outer container 120 will not dissolve the outer container 120. The outer container 120 may be formed from a single layer or multiple layers as a laminate structure, but even in such embodiments the multiple layers are each formed from the same type of material. In one embodiment, the outer container 120 may be formed from polyethylene, and thus polyethylene is the type of material. However, the outer container 120 may be formed as a laminate structure that comprises multiple layers of polyethylene, and each layer may contain the same or a different grade of polyethylene. Different grades of polyethylene include low density polyethylene, linear low density polyethylene, metallocene polyethyelene, medium density polyethylene, and high density polyethylene. Furthermore, within each of the different grades of polyethylene there may be different characteristics such as, for example, different densities and melt flow indexes. Thus, the various layers may be formed from the same grade material with different characteristics or the same characteristics, the various layers may be formed from the same type of material, but different grades, or the various layers may be formed from the same type and grade of material. Many permutations of this are possible and still fall within the scope of the claimed invention. The outer container 120 may be formed form a single layer of polyethylene in some embodiments. In some embodiments, the outer container 120 may be formed from multiple layers of high density polyethylene of varying grades.

In some embodiments, the outer container 120 may be formed entirely from polyethylene such that the outer container 120 does not include any polypropylene, ethylene vinyl alcohol, aluminum, or other materials. In one such embodiment, the outer tube 120 may be formed from a mono-material, that is, the outer tube 120 may be formed entirely from polyethylene, and more specifically high density polyethylene. In other embodiments, the outer container 120 may include trace amounts of ethylene vinyl alcohol or other materials that are different from polyethylene, so long as such trace amounts do not impede the ability of the outer container 120 to be recycled. Thus, for example, the outer container 120 may comprise polyethylene and no more than 5 wt % ethylene vinyl alcohol, as that amount of ethylene vinyl alcohol has been found to not interfere with the ability to properly recycle a container formed from polyethylene.

In some embodiments, the sleeve portion 127 and the shoulder portion 128 of the outer container 120 may both be formed from polyethylene, although the sleeve portion 127 and the shoulder portion 128 may have different rigidities. Specifically, the sleeve portion 127 should be reasonably flexible and compressible so that a user can squeeze the sleeve portion 127 to dispense the consumable substance 200 therefrom. However, the shoulder portion 128 should be reasonably rigid to facilitate proper coupling of the cap 300 to the shoulder portion 128. Thus, the shoulder portion 128 may be more rigid than the sleeve portion 127, despite both the shoulder and sleeve portions 128, 127 being formed from the same type of material (although they could be formed from different grades of the same type of material). However, as noted above, in the exemplified embodiment the outer container 120 in its entirety including the sleeve portion 127 and the shoulder portion 128 are formed from a single type of material so that the outer container 120 is recyclable. In some embodiments, the outer container 120 may be formed from materials other than those described herein so long as the material is not dissolvable.

By forming the outer container 120 out of a single type of material and omitting any metal layers such as aluminum foil, the outer container 120 can be readily recycled using existing recycling technologies and techniques. Moreover, as will be described in greater detail below, the inner container 150 is dissolvable when put into contact with water. Thus, simply by removing the cap 300 and dissolving the inner container 150 prior to recycling, the entirety of the remaining parts of the package 110 (which is just the outer container 120) can be recycled without issue. Furthermore, because the cap 300 is preferably formed from polypropylene, which can be adequately recycled with polyethylene in certain weight percentages, the outer container 120 can be recycled with the cap 300 thereon in some embodiments.

The outer container 120 may be formed in a variety of different ways. For example, because the outer container 120 in the exemplified embodiment is formed from a single type of material, the outer container 120 can be made via an extrusion process. Alternatively, the outer container 120 may be made using other techniques such as injection molding, blow molding, or the like.

Figure 3:
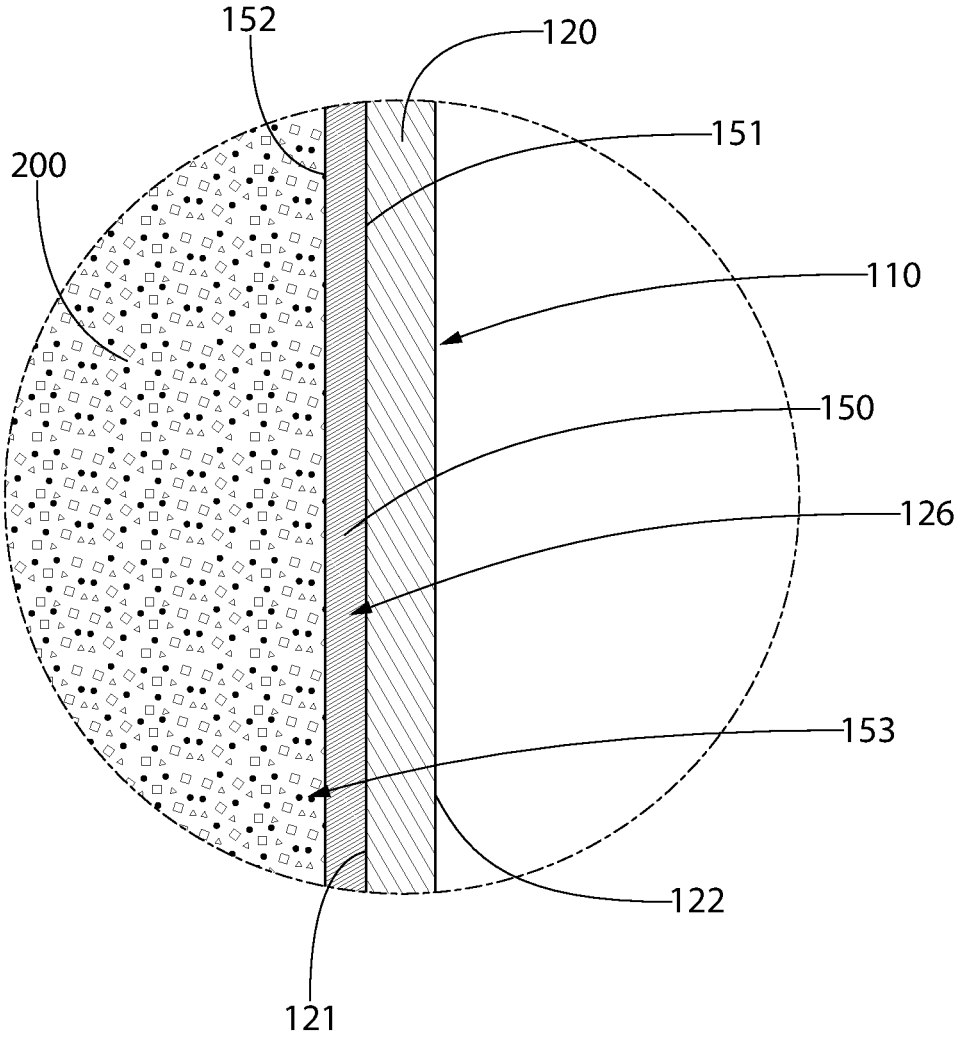
FIG. 3 is a close-up view of area III of FIG. 2.

Referring to FIGS. 2 and 3, the package 110 will be further described. FIG. 3 is a close-up of a portion of FIG.

2, and in FIG. 3 the outer container 120 is illustrated as having a single layer of material. However, as noted above, the outer container 120 may be a laminate structure in other embodiments such that it may be formed from one or more layers of the same type of material.

In the assembled package 110, the inner container 150 is disposed within the first cavity 126 of the outer container 120. The inner container 150 comprises an outer surface 151 which faces the inner surface 121 of the outer container 120 and an inner surface 152 opposite the outer surface 151. The inner surface 152 of the inner container 150 defines a second cavity 153 of the inner container 150. In the exemplified embodiment, the outer surface 151 of the inner container 150 is depicted as being in abutment or contact with the inner surface 121 of the outer container 120. However, the invention is not to be so limited in all embodiments and the inner container 150 may be wholly or partially spaced apart from the inner surface 121 of the outer container 120 in other embodiments, so long as the inner container 150 is entirely located within the first cavity 126 of the outer container 120. The volume of the consumable substance 200 within the inner container 150 may dictate the physical relationship between the inner and outer containers 120, 150.

In that regard, in the exemplified embodiment the inner container 150 may be in physical contact with the inner surface 121 of the outer container 120, but the inner container 150 is not physically coupled or connected to the outer container 120. Thus, the inner container 150 is positioned within the outer container 120 without any physical attachment or coupling occurring between the inner and outer containers 120, 150. Thus, if the inner container 150 is smaller than the first cavity 126 of the outer container 120, the inner container 150 would be capable of sliding or moving around within the first cavity 126. Of course, in alternative embodiments the inner container 150 may be physically coupled to the outer container 120 using any desired techniques, including adhesive, ultrasonic bonding, mechanical interference, or the like, although such physical coupling is not required in all embodiments as noted above. In some embodiments, the process of sealing the first end 123 of the outer container 120 may also result in a physical attachment between the first and second containers 120, 150.

The consumable substance 200 is positioned within and fills the second cavity 153 of the inner container 150. Furthermore, the inner container 150 is completely sealed such that it contains no openings, apertures, or passageways extending between the inner and outer surfaces 151, 152. The inner container 150 may be filled with the consumable substance 200 from an opening in one end thereof and then sealed using techniques known in the art, such as heat sealing, to create the sealed inner container 150. Although heat sealing is mentioned, other sealing techniques can be used, including mechanical sealing techniques (interlocking groove and ridge), adhesive sealing, or the like. Because the inner container 150 is sealed, the consumable substance 200 is encapsulated within the inner container 150. That is, the inner container 150 completely surrounds and encapsulates the consumable substance 200. As a result, even if the cap 300 is removed from the outer container 120, the consumable substance 200 cannot be dispensed from the package 110 until some additional action is taken by the user/consumer, as discussed in more detail below.

The packaged product 100 may be sold to consumers in the form as shown in FIGS. 1 and 2, whereby the inner container 150 is filled with the consumable substance 200 and sealed and is positioned within the outer container 120, and the cap 300 is attached to the outer container 120 to close the opening 125 of the outer container 120. The packaged product 100 may also include an additional seal 140, such as a foil or foam liner, attached to the second end 124 of the outer container 120, although this is not required in all embodiments. Such a seal or liner 140 may protect the integrity of the inner container 150 to ensure that it remains sealed and is not punctured or otherwise opened prior to a consumer bringing the package 110 home and using it for the first time. After purchase, a consumer will remove the cap 300, remove the seal/liner 140, and then perform some action to create a hole in the inner container 150 so that the consumable substance 200 can be dispensed from the package 110.

As noted previously, the inner container 150 is wholly positioned within the first cavity 126 of the outer container 120 such that no portion of the inner container 150 is exposed or forms a part of the outside or exterior of the package 110. In some embodiments, the inner container 150 when filled with the consumable substance 200 may take up at least 80% of the volume of the first cavity 126 of the outer container 120. In other embodiments, the inner container 150 when filled with the consumable substance 200 may take up at least 85%, or at least 90%, or at least 95%, or at least 98% of the volume of the first cavity 126 of the outer container 120.

The inner container 150, when filled with the consumable substance 200, has at least one dimension that prevents removal of the inner container 150 from the first cavity 126 of the outer container 120 when the inner container 150 is sealed. As noted above, the outer container 120 has only one opening, which is the dispensing opening 125 located in the second end 124 thereof. As with traditional toothpaste tubes, the dispensing opening 125 is reasonably small, having a diameter between 3 mm and 15 mm, and more specifically between 3 mm and 10 mm, and still more specifically between 3 mm and 8 mm. The width or diameter of the inner container 150 is greater than the diameter of the dispensing opening 125 such that the inner container 150 cannot be removed from the first cavity 126 of the outer container 120 through the dispensing opening 125. Thus, the only way to dispense the consumable substance 200 from the package 110 is to create a hole in the inner container 150 so that the consumable substance 200 can be dispensed from the inner container 150, and then through the dispensing opening 125 in the outer container 120.

The inner container 150 is not multiple separate distinct containers that can be separately dispensed from the outer container 120 without rupture and then ruptured after removal to access and use the consumable substance 200. Rather, the inner container 150 is a singular container that fills at least 80% of the volume of the first cavity 126 of the outer container 120 when it is filled with the consumable substance 200. A hole is formed into the inner container 150 by the consumer/user after purchase and before first use while the inner container 150 remains positioned within the first cavity 126 of the outer container 120. This is an important distinction, and one perceived benefit is that once the hole is formed into the inner container 150 (again, this will be discussed in greater detail below), the package 110 is used in the normal manner that users are accustomed to. Thus, once the hole is formed into the inner container 150, the user can simply squeeze the package 110 to compress the outer container 120 and force the consumable substance 200 to be dispensed through the dispensing opening 125. Once the hole is formed into the inner container 150, there is no difference in terms of how the package 110 is operated to dispense the consumable substance 200 therefrom as compared to operation of a traditional container of the same type. For example, if the package 110 is a toothpaste tube, it is used and operated to dispense the consumable substance 200 in the same manner as a conventional toothpaste tube once the inner container 150 has a hole in it.

The consumable substance 200 may be any viscous liquid, gel, or paste product, examples of which include toothpaste, mouthwash, condiments (e.g., ketchup, mustard, mayonnaise), soap, detergent, medicinal preparations, body wash, body lotion, shampoo, conditioner, cosmetic products (e.g., creams), ointments, and lotions. In one particular embodiment, the consumable substance is toothpaste. As noted previously, the consumable substance 200 is disposed within and fills the second cavity 153 of the inner container 150. Thus, prior to first use of the package 110, the consumable substance 200 is maintained in spaced relation to the outer container 120. Specifically, the inner container 150 surrounds the consumable substance 200 and prevents contact between the consumable substance 200 and the outer container 120. It is only after a hole is formed into the inner container 150 that the consumable substance 200 may come into direct contact with the outer container 120.

In the exemplified embodiment, the inner container 150 is formed from a dissolvable material. As used herein, the phrase dissolvable material refers to a material which is dissolvable in water. Thus, the inner container 150 will dissolve when immersed in water and/or when drops of water are poured onto the inner container 150 or when water is otherwise made to come into contact with the inner container 150. In one particular embodiment, the dissolvable material is polyvinyl alcohol, such as including without limitation POVAL from Kuraray Co. Ltd. Polyvinyl alcohol is a water soluble polymer whose water solubility may depend on its degree of hydrolysis, molecular weight, and tendency to hydrogen bond in aqueous solutions. The polyvinyl alcohol used to form the inner container 150 may be sufficiently dissolvable such that one, or a few, drops of water may dissolve a portion of the inner container 150 and form a hole therein.

In one embodiment, the polyvinyl alcohol used to form the inner container 150 may not be completely hydrolyzed (i.e., it is partially hydrolyzed). The normal means for making polyvinyl alcohol is the polymerization of vinyl acetate monomer to form a polyvinyl acetate which is insoluble in water. The polyvinyl acetate is then subsequently hydrolyzed to form polyvinyl alcohol.

In one embodiment, the partially hydrolyzed polyvinyl alcohol has a degree of saponification of at least 60 mol. % and a degree of polymerization of 300 to 2700. In another embodiment of this aspect of the invention, the degree of saponification is selected from the group consisting of greater than 80 mol. %, greater than 90 mol. %, greater than 97 mol. %, in each case the degree of saponification being less than 100 mol. %.

In one embodiment, the polyvinyl alcohol which is not completely hydrolyzed has improved viscosity stability relative to fully hydrolyzed polyvinyl alcohol at 20° C. and 5° C. In one embodiment, the polyvinyl alcohol which is not completely hydrolyzed has increased alkali resistance and higher water solubility than fully hydrolyzed polyvinyl alcohol.

The inner container 150, when formed from polyvinyl alcohol as described herein, acts as a flavor or aroma barrier for the consumable substance 200. This may be needed in some embodiments to ensure that the product/consumable substance 200 maintains its flavor and/or aroma even after being on a store shelf for many months or even a year or two. Thus, if the outer container 120 were to be used without the inner container 150, the shelf life of the package 110 would be significantly reduced because the flavor/aroma of the consumable substance 200 would deteriorate over time. By including the inner container 150, similar flavor/aroma barrier results can be achieved as done previously with conventional tubes that use an ethylene vinyl alcohol or aluminum foil layer. The outer container 120 may serve as a moisture barrier.

Figure 4A:
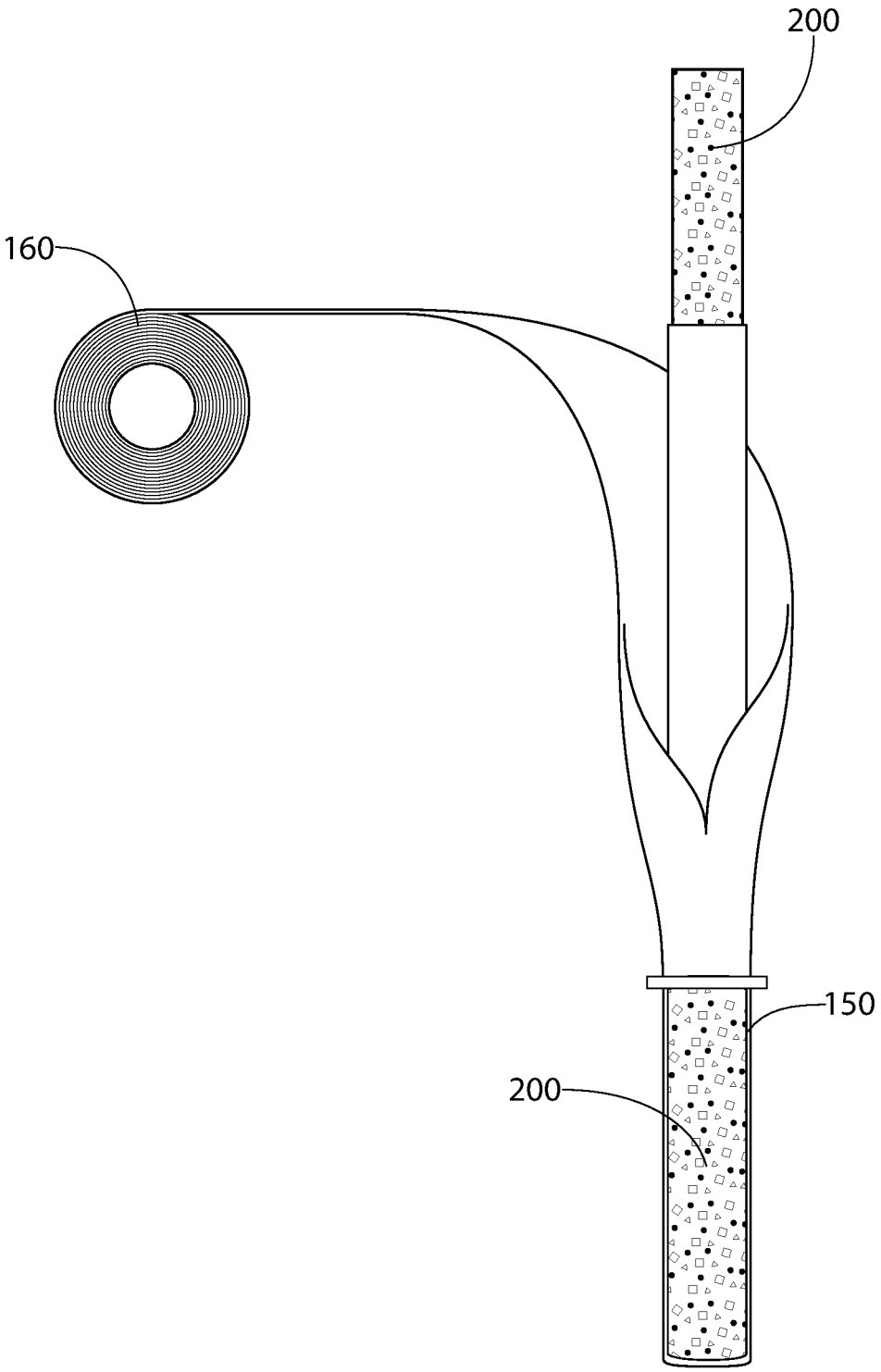
FIG. 4A is a schematic illustration of the formation of the inner container of the packaged product of FIG. 1 and the process of filing the inner container with the consumable substance.
Figure 4B:
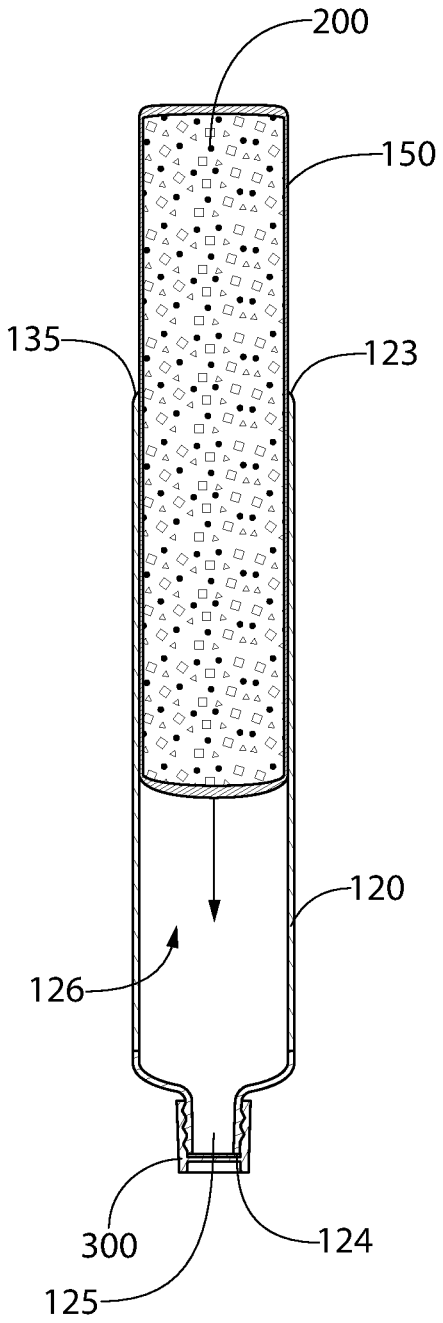
FIG. 4B is a cross-sectional view of the packaged product illustrating the process of inserting the inner container of into a cavity of the outer container to form the packaged product of FIG. 1.

Referring to FIGS. 4A and 4B, the method of manufacturing the packaged product 100 will be described. First, as shown in FIG. 4A, the inner container 150 is simultaneously formed and filled with the consumable substance 200 and then sealed. This may be achieved via form-fill-seal technology using a conventional form-fill-seal machine, although this is not required in all embodiments and other methods and techniques can be used to achieve the same end in other embodiments. In accordance with the exemplified embodiment, a roll 160 of the dissolvable material (i.e., polyvinyl alcohol in the exemplified embodiment) which is used to form the inner container 150 is fed into a portion of the machine which forms the material into the desired shape of the inner container 150. The inner container 150 is then, or simultaneously, filled with the consumable substance 200. Finally, once the inner container 150 is filled with the desired amount or volume of the consumable substance, the inner container 150 is sealed. When the inner container 150 is sealed, it is sealed at both ends so that there is no passageway that would allow the consumable substance 200 contained within the inner container 150 to leak out of the inner container 150. Thus, after the steps shown in FIG. 4A are completed, the sealed inner container 150 which is pre-filled with the consumable substance 200 is ready to be inserted into the outer container 120 to form the packaged product 100. The inner container 150 may be sealed using heat sealing techniques, adhesive, or the like in various embodiments.

Next, referring to FIG. 4B, the inner container 150 is inserted into the first cavity 126 of the outer container 120. Specifically, prior to what is shown in FIG. 4B, the outer container 120 is formed. The outer container 120 may be formed using blow molding, injection molding, extrusion, or the like. The outer container 120 is preferably formed entirely, or substantially entirely (about 90 wt %, or 95 wt %), from polyethylene such as one or more grades of high density polyethylene. Upon initially forming the outer container 120, the outer container 120 comprises the opening 125 in the second end 124 which forms the dispensing opening, and it also comprises a fill opening 135 in the first end 123 thereof. The inner container 150 is inserted into the first cavity 126 of the outer container 120 through the fill opening 135 in the first end 123 of the outer container 120. The inner container 150 is inserted into the first cavity 126 until no portion of the inner container 150 protrudes through the fill opening 135 and the entirety of the inner container 150 is located within the first cavity 126. At this point, the fill opening 135 in the first end 123 of the outer container 120 is closed and sealed. The first end 123 of the outer container 120 may be sealed using a heat sealer or other conventional techniques.

Once the inner container 150 is inserted into the first cavity 126 of the outer container 120 and the first end of the outer container 120 is sealed, the result is the packaged product 100 as shown in FIGS. 1 and 2. The packaged product 100 includes only one passageway (the opening 125) through which the consumable substance 200 may be dispensed. As shown in FIG. 4B, the cap 300 is coupled to the outer container 120 to close the opening 125, and the cap 300 can be removed or altered into the open state when it is desired to dispense some amount of the consumable substance 200 from the package 110. As best seen in FIG. 2 and discussed above, due to the dimensions of the inner container 150 as compared to the dimensions of the opening 125, the inner container 150 cannot be removed from the first cavity 126 of the outer container 120 via the opening 125.

Figure 5A:
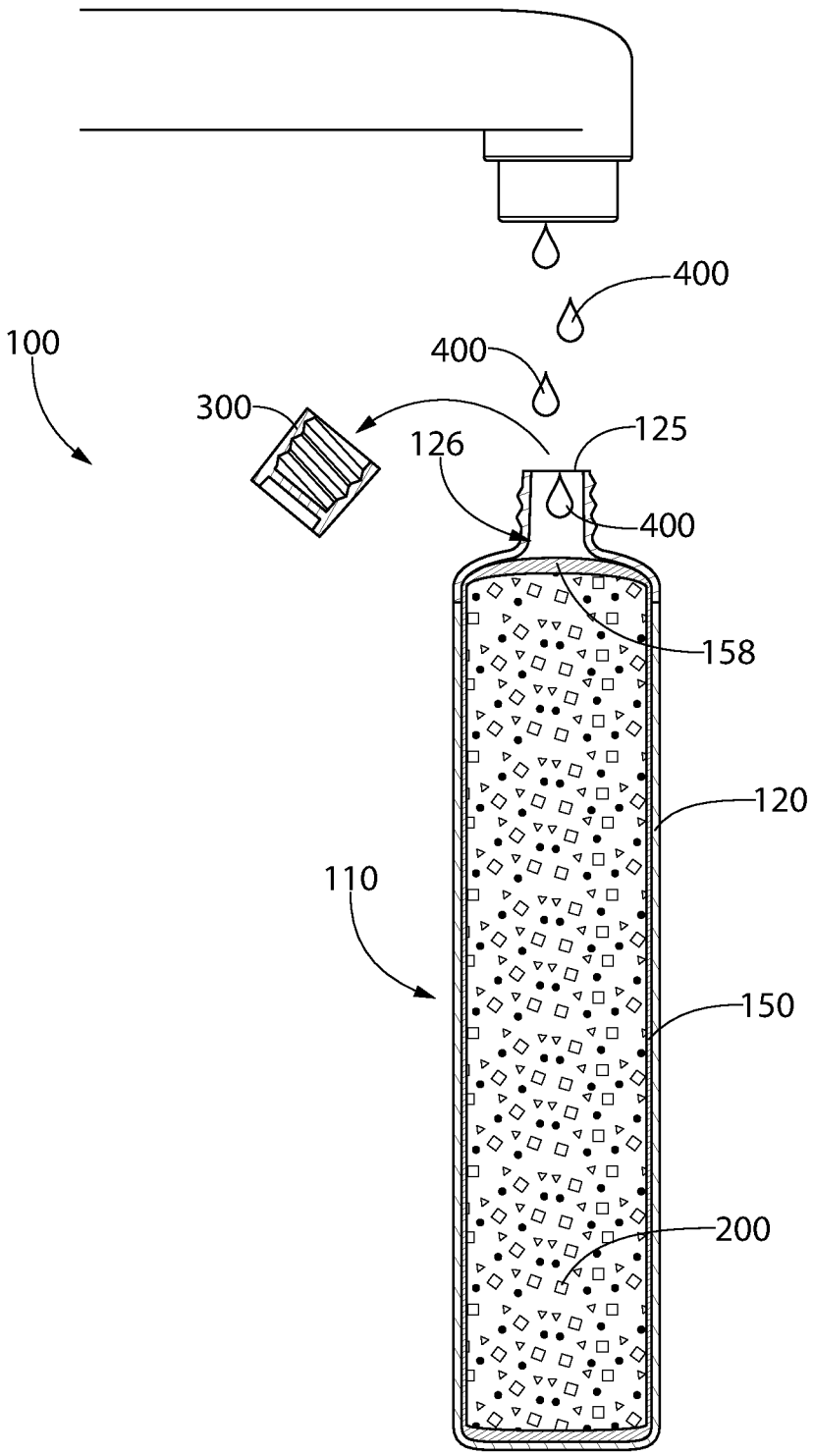
FIG. 5A is a schematic illustration of the introduction of water into the cavity of the outer container to dissolve a portion of the inner container so that the consumable product can be dispensed.
Figure 5B:
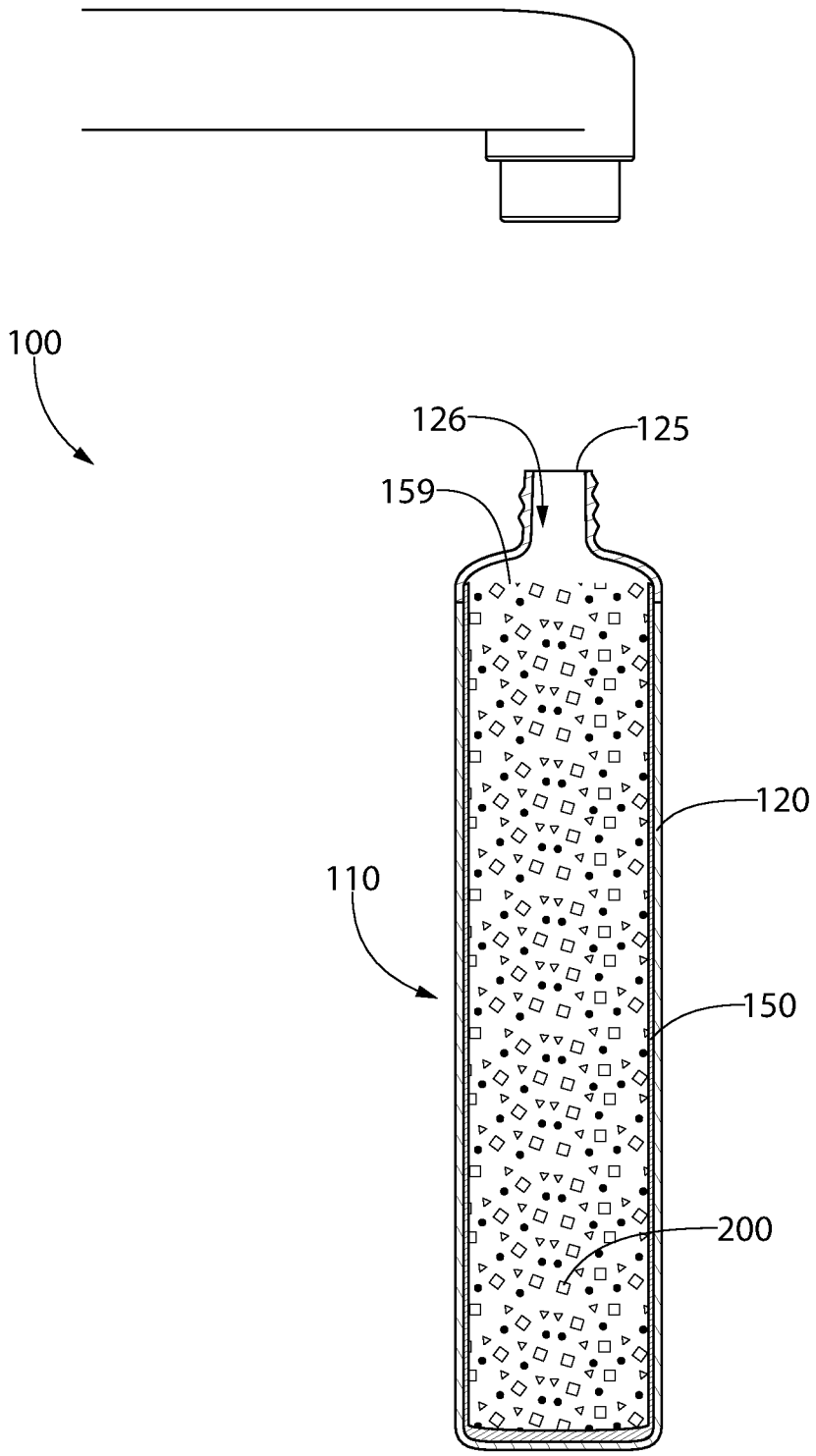
FIG. 5B is the cross-sectional view of FIG. 2 with a cap removed from the outer container and a portion of the inner container dissolved.
Figure 5C:
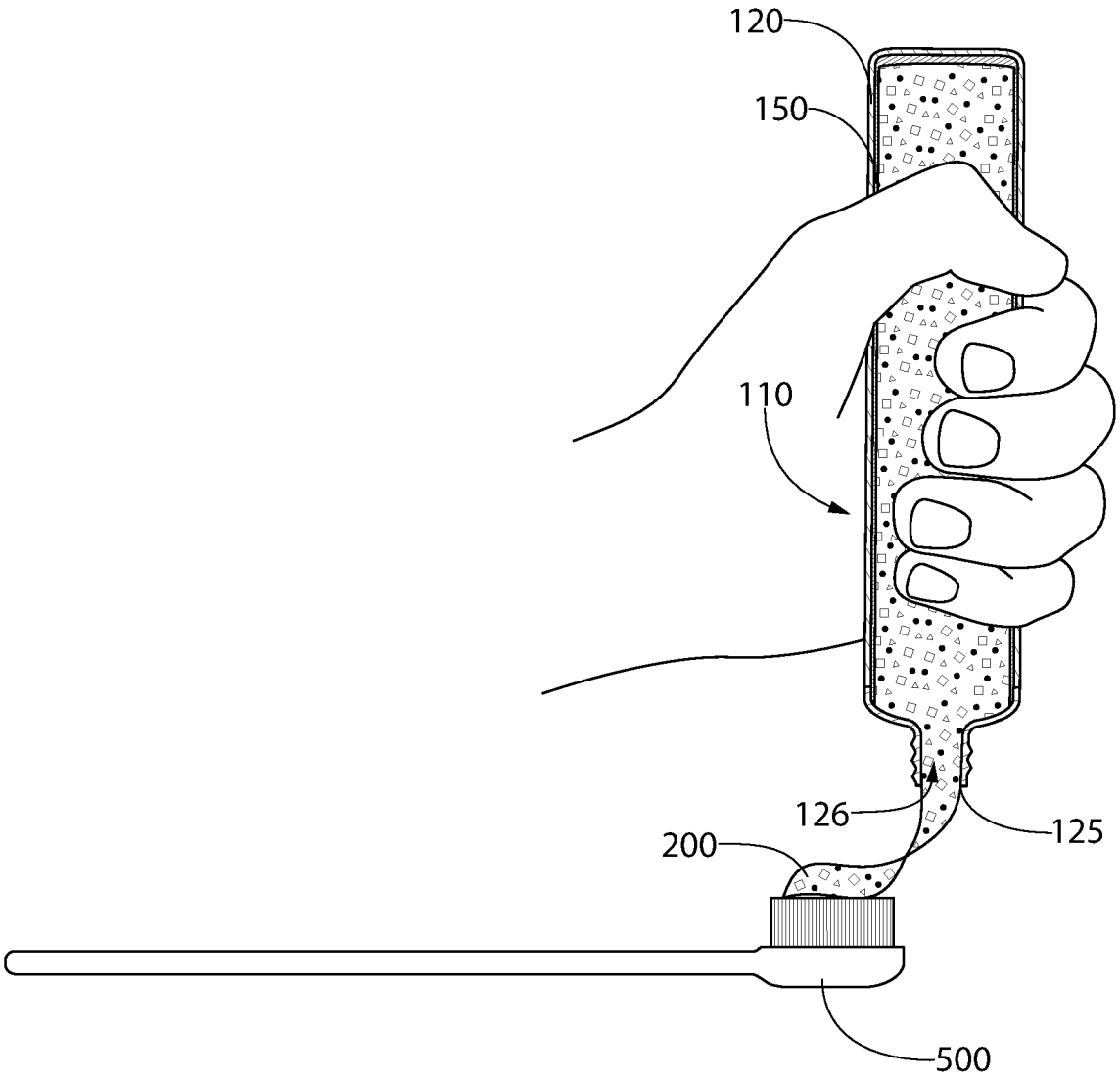
FIG. 5C is a schematic illustration of a user squeezing the packaged product to dispense the consumable substance therefrom.

Referring to FIGS. 5A-5C, a method of dispensing the consumable substance 200 from the package 110 will be described. As mentioned above, prior to first use of the packaged product 100, the inner container 150 is completely sealed so that there is no way for the consumable substance 200 to be dispensed without first creating a hole in the inner container 150. As also noted above, in the exemplified embodiment the inner container 150 is formed from a dissolvable material, such as for example without limitation polyvinyl alcohol. While polyvinyl alcohol is described as being used as the dissolvable material in the exemplified embodiment, the invention is not to be so limited. Other materials that dissolve in water which are now known or may be later discovered and which can contain the consumable substance 200 in a sealed environment as described herein may be used as the dissolvable material for the inner container 150.

Referring to FIG. 5A, the first step in the method of dispensing is to remove the cap 300 from the outer container 120, which has already been done in FIG. 5A. As noted above, the cap 300 may be hingedly coupled to the outer container 120 or, as with the exemplified embodiment, the cap 300 may be separate from and not attached to the outer container 120 when it is altered into the open state. Next, one or more drops of water 400 may be introduced into the first cavity 126 of the outer container 120 through the opening 125. In the exemplified embodiment, this is achieved by positioning the packaged product 100 directly beneath a faucet and turning on the faucet to flow a few drops of water 400 into the opening 125. In other embodiments, water may be poured from a cup or other container or injected from a syringe into the opening 125 of the outer container 120.

Referring to FIGS. 5A and 5B concurrently, upon the drops of water 400 entering into the first cavity 126 through the opening 125 in the outer container 120, the drops of water 400 will come into contact with the inner container 150. As discussed above, the inner container 150 is formed from a dissolvable material such as polyvinyl alcohol, and thus the contact of the drops of water 400 with the inner container 150 will cause the inner container 150 to begin to dissolve. Depending on the nature and structure of the dissolvable material, it may be that a single drop of water is sufficient to dissolve a portion of the inner container 150 to form a hole therein, but in other embodiments multiple drops of water may be needed. Upon a sufficient amount of the water being introduced into the first cavity 126 through the opening 125, a portion of the inner container 150 will dissolve and a hole 159 is formed through the inner container 150. In the exemplified embodiment, an entire top portion of the inner container 150 has dissolved. However, in other embodiments a smaller portion of the inner container 150 may dissolve. It may be desirable to introduce a sufficient amount of water into the package 110 to form a hole having a diameter of at least 3 mm, or at least 5 mm, or at least 8 mm, into the inner container 120.

In the exemplified embodiment, the inner container 150 has a top portion 158, at least a portion of which is aligned with the opening 125 in the outer container 120. Thus, the water drops 400 being introduced through the opening 125 are certain to contact the top portion 158 of the inner container 150 so that the hole 159 can be formed into the top portion 158 of the inner container 150 due to at least a portion of the top portion 158 of the inner container 150 dissolving.

Next, referring to FIG. 5C, the packaged product 100 is ready to be used by dispensing the consumable substance 200 therefrom. In the exemplified embodiment, the packaged product 100 is a tube containing toothpaste as the consumable substance 200. Thus, the packaged product 100 is positioned with the opening 125 adjacent to the bristles of a toothbrush 500, and then the package 110 is squeezed to dispense the consumable substance 200 through the opening 125 and onto the bristles. Because the inner container 150 has the hole 159 therein, upon squeezing the package 110 with the cap 300 removed (or altered into the open state), the consumable substance 200 will flow through the hole 159, through the opening 125, and onto the bristles of the toothbrush 500. Of course, the consumable substance 200 need not be toothpaste in all embodiments. Thus, for example, the consumable substance 200 may be an ointment, and the ointment may be dispensed onto a user's finger for proper application. In other embodiments, the consumable substance may be a condiment, and it may be dispensed directly onto a plate or article of food. Thus, variations in end-use are possible and dependent upon the type of consumable substance stored in the package 110.

It should be noted that the inner container 150 is never removed from the cavity 126 of the outer container 120. Rather, the hole 159 is formed into the inner container 150 and the consumable substance 200 is dispensed from the inner container 150 and then from the opening 125 in the outer container 120. Thus, in accordance with the invention set forth herein, there are never capsules containing the consumable substance that are removed from the cavity 126 of the outer container 120. Instead, the consumable substance 200 is dispensed from the package 110 on its own just like with a traditional flexible tube-like dispensing package. The inner container 150 remains located within the cavity 126 of the outer container 120 until the consumable substance 200 is depleted, and then the inner container 150 can either be dissolved by the user introducing additional water into the cavity 126 or it may be dissolved during the recycling process, which requires the use of water in various stages of the process.

After a single use of the packaged product 100 to dispense a desired volume of the consumable substance 200 needed for a single toothbrushing session (or for another purpose depending on what type of substance the consumable substance 200 is), the cap 300 can be altered back into the closed state. The packaged product 100 can then rest unused on a user's shelf, cabinet, or the like until it is next needed. For each subsequent use of the packaged product 100 after the first, the user will not need to introduce water into the package 110 because the inner container 150 has already been dissolved to form the hole 159. Thus, for each subsequent use, the packaged product 100 is used in the normal, conventional manner, which in the exemplified embodiment includes altering the cap 300 into the open state and then squeezing the package 110 to dispense the consumable substance 200 therefrom.

In some embodiments, prior to recycling the package 110, a user may desire to dissolve the remainder of the inner container 150. Thus, upon the consumable substance 200 being depleted from the package 110, the user can introduce additional amounts of water into the cavity 126 to dissolve the rest of the inner container 150. At this point, the outer container 120 (either with the cap 300 thereon or with the cap 300 removed) can be recycled, because the outer container 120 is made from a single material and any other materials are below a threshold (i.e., trace amounts, which is less than 5 wt % of any other materials), which still enables them to be recycled with the main material of the outer container 120.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. A package for holding and dispensing a consumable substance, the package comprising:

an outer container formed from a non-dissolvable material, the outer container having an inner surface that defines a first cavity and an opening that forms a passageway into the first cavity, wherein the non-dissolvable material does not dissolve when placed into contact with water;

a cap coupled to the outer container to close the opening;

an inner container formed from a water dissolvable material positioned within the first cavity of the outer container, the inner container comprising a second cavity and being sealed; and a consumable substance disposed within the second cavity of the inner container;

wherein the inner container, when filled with the consumable substance, comprises at least one dimension that prevents removal of the inner container from the first cavity of the outer container while the inner container is sealed;

wherein upon altering the cap from a closed state to an open state and introducing one or more drops of water into the first cavity through the opening in the outer container, at least a portion of the inner container dissolves thereby creating a hole in the inner container through which the consumable substance is configured to be dispensed from the inner container.

2. The package according to claim 1 wherein the outer container is formed from one or more layers of a single type of plastic material such that the outer container is recyclable.

3. The package according to claim 1 wherein the inner container is not physically attached to the outer container.

4. The package according to claim 1 wherein the non-dissolvable material is polyethylene.

5. The package according to claim 1 wherein the outer container is free of metal and contains no more than 5 wt % ethylene vinyl alcohol.

6. The package according to claim 1 wherein the water dissolvable material is polyvinyl alcohol.

7. The package according to claim 1 wherein the outer container comprises a sleeve portion and a shoulder portion, the shoulder portion comprising a nozzle and the opening, and wherein the sleeve and shoulder portions are both formed from polyethylene and are devoid of metal and contain no more than 5 wt % ethylene vinyl alcohol to facilitate acceptable recyclability of the outer container, and wherein the shoulder portion has a greater rigidity than the sleeve portion.

8. The package according to claim 1 wherein the consumable substance is a viscous material, a gel, or a paste product.

9. The package according to claim 1 wherein the consumable substance is selected from the group consisting of toothpaste, mouthwash, condiments, soap, detergent, medicinal preparations, body wash, body lotion, shampoo, conditioner, and lotion.

10. The package according to claim 1 wherein the inner container, when filled with the consumable substance, occupies at least 80% of a volume of the first cavity of the outer container.

11. A packaged product comprising:

a flexible tube comprising a cavity and an opening that forms a passageway into the cavity;

a cap alterable between a closed state whereby the cap is coupled to the flexible tube and closes the opening and an open state whereby the opening is exposed;

a flexible container positioned within the cavity of the flexible tube; and a consumable substance disposed within the flexible container;

wherein the flexible container is sealed prior to first use of the packaged product, and wherein introducing one or more drops of water into the first cavity through the opening in the outer container dissolves at least a portion of the flexible container thereby forming a hole in the flexible container through which the consumable substance is configured to be dispensed.

12. The packaged product according to claim 11 wherein the flexible tube is formed from a single type of plastic material and only trace amounts of other materials, if any, such that the flexible tube is recyclable.

13. The packaged product according to claim 11 wherein the flexible container is formed from polyvinyl alcohol.

14. A packaged product comprising:

an outer container comprising a cavity and an opening that forms a passageway into the cavity;

a cap coupled to the outer container to close the opening;

an inner container positioned within the cavity of the outer container, the inner container being sealed; and a consumable substance disposed within the inner container;

wherein the inner container filled with the consumable substance comprises at least one dimension that prevents removal of the inner container from the cavity of the outer container while the inner container is sealed;

wherein prior to first use the cap is altered from a closed state to an open state to expose the opening of the outer container and a hole is formed in the inner container through which the consumable substance is configured to be dispensed; and wherein the inner container is formed from a water dissolvable material, and wherein the hole is formed in the inner container by introducing one or more drops of water into the cavity through the opening in the outer container which dissolves at least a portion of the inner container.

15. The packaged product according to claim 14 wherein the inner and outer containers are compressible.

* * * * *